US011503925B1

(12) United States Patent
Walker

(10) Patent No.: US 11,503,925 B1
(45) Date of Patent: Nov. 22, 2022

(54) PRODUCT DISPLAY STAND

(71) Applicant: Brian B Walker, Big Lake, MN (US)

(72) Inventor: Brian B Walker, Big Lake, MN (US)

( * ) Notice: Subject to any disclaimer, the term of this patent is extended or adjusted under 35 U.S.C. 154(b) by 792 days.

(21) Appl. No.: 14/999,121

(22) Filed: Mar. 31, 2016

Related U.S. Application Data

(60) Provisional application No. 62/178,830, filed on Apr. 20, 2015.

(51) Int. Cl.
*A47F 3/04* (2006.01)
*A47F 5/00* (2006.01)

(52) U.S. Cl.
CPC ..... *A47F 3/0434* (2013.01); *A47F 5/0018* (2013.01)

(58) Field of Classification Search
CPC ..... A47F 3/0434; A47F 3/06; A47F 3/0486; A47F 5/0018; A47F 5/0081
USPC ..... 312/114, 116; 362/92, 125, 126
See application file for complete search history.

(56) References Cited

U.S. PATENT DOCUMENTS

2004/0060884 A1* 4/2004 Nook ..... A47F 5/0018 211/189
2006/0273706 A1* 12/2006 Champagne ..... A47F 3/0439 312/401
2007/0022644 A1* 2/2007 Lynch ..... A47B 13/08 40/446
2008/0158858 A1* 7/2008 Madireddi ..... A47F 3/001 362/92
2008/0205042 A1* 8/2008 Shibusawa ..... A47F 3/001 362/125
2012/0105424 A1* 5/2012 Lee ..... G09F 9/35 345/212
2015/0073946 A1* 3/2015 Werner ..... A47F 1/00 705/27.2

FOREIGN PATENT DOCUMENTS

CA 2169243 A1 * 8/1996 ..... A47F 1/04

* cited by examiner

*Primary Examiner* — Filip Zec
(74) *Attorney, Agent, or Firm* — Johnson & Phung LLC

(57) ABSTRACT

A free standing display case with a product display system capable of displaying product and delivering multiple different messages with the illumination of the product and the illumination of a product display panel separable from each other with the information on the illuminated product display panel generated from a backlit panel.

1 Claim, 3 Drawing Sheets

PRODUCT DISPLAY STAND

CROSS REFERENCE TO RELATED APPLICATIONS

This application claims priority from provisional application Ser. No. 62/178,830 filed Apr. 20, 2015.

STATEMENT REGARDING FEDERALLY SPONSORED RESEARCH OR DEVELOPMENT

None

REFERENCE TO A MICROFICHE APPENDIX

None

BACKGROUND OF THE INVENTION

The use of display shelf risers to hold products on display and permit store operators, such as those in the grocery store industry, and more specifically store operators who display their product in free standing cases such as refrigerated cases is known in the art. It is also known that it is appealing to the customers if one decoratively organizes the products for display within the refrigerated display case. There exist different types of refrigerator cases, some refrigerator cases are self serve so the consumer can open a door and remove a product while in other cases the store operator needs to remove the product and hand it to the customer, which is particularly true in meat cases where meat products are sold by the pound. In those cases the meat product may be removed from the refrigerator case then sliced, weighed and price marked for checkout by the customer.

In either type of refrigeration case it is necessary that the products within the refrigeration case are properly illuminated so the customer can readily see what products are available for purchase since the glass panels in front of the refrigeration preclude the purchaser from handling and inspecting the product in the case. In some refrigeration cases a product illumination light is located within the refrigeration case so that a consumer standing in front of the display case can properly view the product. In other display cases one may attempt to take advantage of the available store lights to illuminate the products within the display case. Regardless of the type of display case and the illumination within the display case a storeowner needs to properly illuminate the product so the consumer can see what is available.

A poorly illuminated product within a display case may appear less appealing than a fully illuminated product or worse may not be seen by the consumer. Other factors may affect the illumination of the product and the product signs within the refrigerator, for example some refrigerator cases are open and others are closed cases where a store operator or a customer needs to open a door to remove the product. Typically, open and closing a door may lead to a viewing panel on the refrigerator case becoming obscured by moisture. It is therefore important that a customer can see all the pertinent information from outside the refrigeration case so that the customer or the store operator can open the refrigeration door and quickly remove the product without having to search for the right product with the door open.

Shelf display risers are often used to hold a product and typically comprise a base having multi-level surfaces for supporting products thereon and some type of barrier to help retain the product thereon.

It is also know in the art to place paper or plastic signs containing information regarding the product, such as the price of the product being displayed either on the display case, in the display case or on the shelf display riser. Typically, such minimum information as the brand name of the product and the price of the product needs to be visible to the consumer at all times. In most cases, the internal or incase signs are placed just above the products or on the base of the shelf liner riser along, which often blocks the view of the product due to the size constraints of the shelves. In addition, due to their size and static nature the aforementioned incase signs usually have a difficult time drawing the consumer's attention to the product being displayed since the signs may be poorly illuminated.

Another drawback of using the above traditional incase signs to convey information to potential consumers is that due to their static nature changes to information displayed on the incase signs, and desired or necessary changes to the information on the incase signs must be done manually and at each physical location, which can make the process of updating the incase signs both time consuming and laborious.

A further disadvantage, which may not be recognized, is that often the proper illumination of the product information incase sign and the proper illumination of the product may be difficult to achieve with either an internal or external light because the optimum light for illumination of product information and the optional lighting for product appearance may be different causing one or the other to be degraded.

SUMMARY OF THE INVENTION

A freestanding case with a product display system comprising a plurality of product display stands with each of the stands capable of displaying a product while delivering different messages through a product display panel thereon with the illumination of the product and the illumination of the product display panel separable from each with the information on the product display panel illuminated from within the panel to prevent the obscuring of information from the consumer through improper external illumination.

DESCRIPTION OF THE PREFERRED EMBODIMENT

Figure 1:
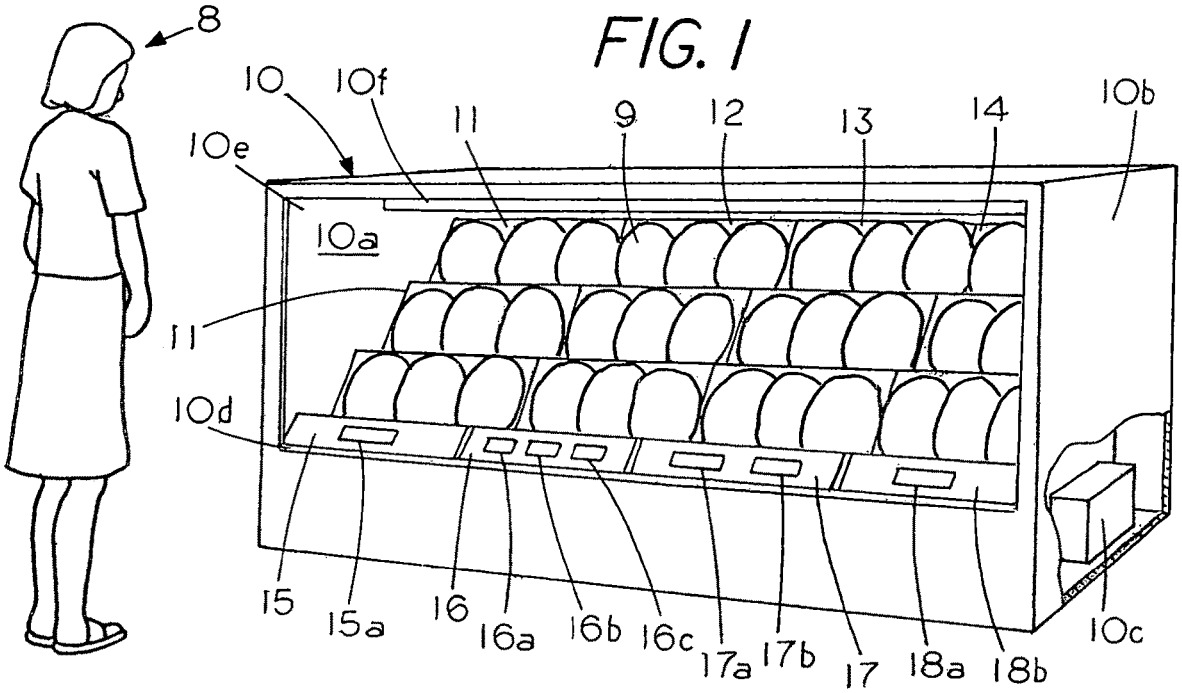
FIG. 1 is a perspective view of a customer in front of a freestanding refrigerator case containing a set of product display stands.

FIG. 1 is a perspective view of a prospective customer 8 peering into a freestanding refrigerator display case 10. Refrigerator display case 10 includes a housing 10*b* having a product display compartment 10*a* and a refrigeration unit 10*c* for maintaining the product display compartment l0*a* at a safe storage temperature. In this example perishable products such as hams 9 are shown although other types of products including cheese products may also be displayed. Located within display compartment l0*a* is a display case shelf 10*d*, which extends from side to side and front to back of case 10 to provide support for the perishable products located within the housing 10*b*. A transparent viewing panel 10*e* at the front of refrigerator display case 10, which is low to the floor, allows the prospective customer 8 to peer down into the product display compartment l0*a* from a position outside and in front of the product display compartment 10*a*. Customer 8 can view the row of products 9 therein, which are supported on a set of four product display stands 11, 12, 13 and 14 that display the perishable product 9 in a customer viewable position. An incase light 10*f* extends across the top of the refrigerator display case 10 to illuminate the contents of the refrigerator display case.

In this example, product information panels, which are on each of the product display stands 11, 12, 13, and 14, may be informationally coordinated to provide both static and dynamic consumer information about the products on the display stands. Although four product display stands are shown more or less product display stands may be used without departing from the spirit and scope of the invention. A feature of the use of multiple product display stands each with a frontal information panel that can be changed on the go is that more information can be displayed. An additional feature is the shifting of display information from one information panel to an adjacent information panel has the added benefit of avoiding problems of image persistence if the information panels are LCD panels.

In the example shown in FIG. 1 four-product display stands 11, 12, 13, and 14 are shown with each of the product display stands each having an information panel with a different message. That is, product display stand 11 has an LCD panel 15 with an image 15*a* thereon. Product display stand 12 has an LCD panel 16 with images 16*a*, 16*b* and 16*c* thereon. Product display stand 13 has an LCD panel 17 with an image 17*a* and 17*b* thereon and product display stand 14 has an LCD panel 18*b* with an image 18*a* thereon. A feature of the invention is that each of the product display stands displays consumer information thereon with each display stand information panel self illuminated and changeable on-the-go. If desired, the content of the information on the LCD panel can be changed manually or automatically. In the example shown the self-illuminated information display panel on the product display stand is located at an acute angle to the horizon so that person standing outside the refrigerator case and looking downward can readily view or read the information on the display panel.

Thus, the present invention includes a product display stand with a self illuminated information delivery system that includes a self illuminated information panel for use in refrigerated cases such as deli display cases or the like. A feature of the invention is the information on the information panels can be changed on-the-go either through manual, mechanical or electrical controls. The self illumination of the information through internal light generation within the information panel allows one to ensure that the information signs on the product display stand are visible and readable regardless of the condition of the product lighting within the refrigeration case. The changing of the information on the information panel on-the-go also has the benefit of enhancing the consumer's attention to the product being displayed.

Another feature of the present invention is that the product display stand with the self illuminated information panel may be readily used with most existing refrigerated product display cases since the information panel generates its own internal light independent of the light directed onto the products located in the refrigerator case. As the products are three-dimensional packages the product lighting can be important in order to avoid shadows that would obscure the product. However, proper product lighting does not ensure proper lighting of the information signs located in the refrigeration case. In the invention described herein one can use the internal lighting within the refrigerator case or some cases one may use external lighting outside the refrigerator case to properly illuminate the products within the display case. Often the incase lighting or the external lighting may or may not properly illuminate the prior art information signs in the refrigeration case. In this invention the information display panel is independently illuminated through a device such as a LCD panel that generates its own light through back lighting. The use of backlighting allows one to display product information in a consumer readable manner, which is not dependent of the lighting within the refrigerator case thus ensuring that the consumer can properly view both the product and the information on the products, which are both, located in the refrigeration case.

Figure 2:
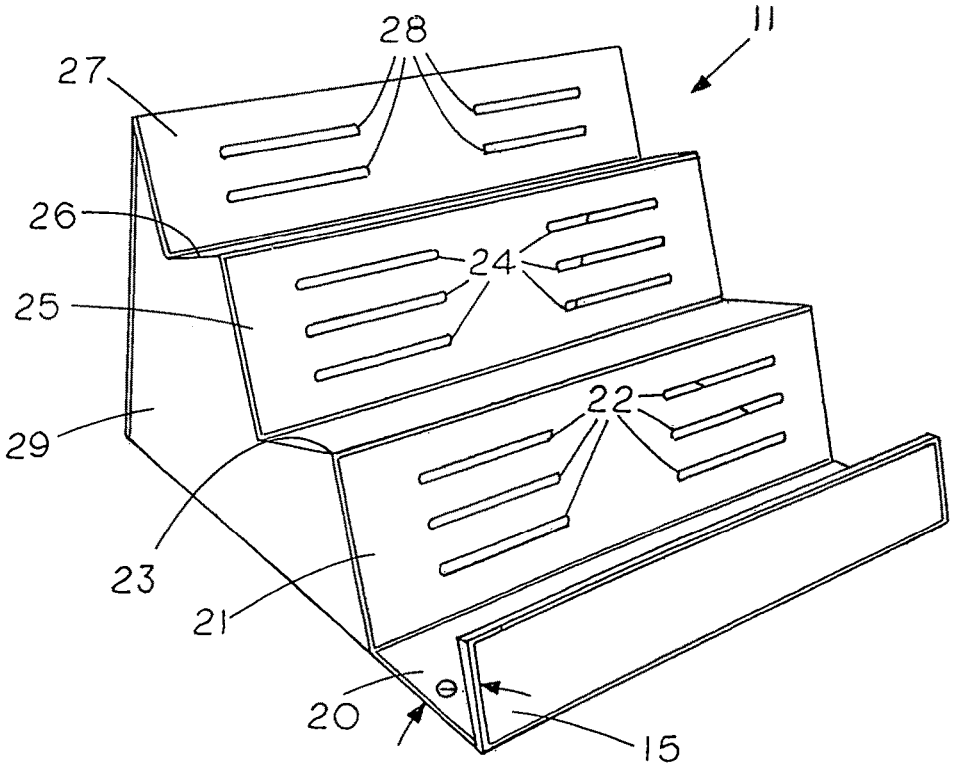
FIG. 2 is a perspective view of a product display stand with an LCD front information panel.

FIG. 2 shows an isolated view of a first removable product display stand 11 having a first product support ledge 20 with a back panel 21 having ribs 22, a second product support and display ledge 23 with a back panel 25 having ribs 24, and a third product support and display ledge 26 with a back panel 27 having ribs 28. Extending upward from the front of product display stand 11 is an information panel 15, such as an LCD panel, that extends from side to side of the product display stand 11 as well as cantilevering upward preferably at an acute angle Θ from the display ledge 20 thereby making it easier for a person standing in front of the refrigerator case to read the information panel. The product display stand 11, which FIG. 1 shows located in the refrigeration case 10 and spaced from the transparent viewing panel 10*e* on the refrigeration case, enables a viewer 8 to inspect the rows of meat products 9 within the refrigeration case 10 as well as read the information on the LCD display panel 15 while standing in front of the refrigerator case 10.

The display panel 15 preferably comprises a liquid crystal display since the display panel is thin and operates without generating heat that may affect the perishable products thereon. A further feature is the LCD panel generates its own light thus eliminating problems of poor external lighting of signs within the refrigeration case. As shown display panel 15 cantileverly extends upward from the support ledge 20 and from side to side of product display stand 11. A feature of the LCD panel is that the LCD panel can form a front stop so the LCD panel can support the product located on ledge 20 without affecting the product since the LCD panel does not generate heat that would spoil the product in contact therewith. Thus a further feature of the use of the LCD panel in the refrigeration case is that the information panel can be illuminated independent of the light on the products.

FIG. 2 is a perspective view showing an embodiment of a display shelf riser or product display stand 11 with the display shelf riser supportable and displayable in an enclosed refrigerated deli display case. As shown in FIG. 2 stand 11 includes a riser body having at least two product supporting surfaces of different heights or steps for receiving and displaying refrigerated deli products such as meats and dairy products thereon in an enclosed refrigerated deli display case.

Figure 4:
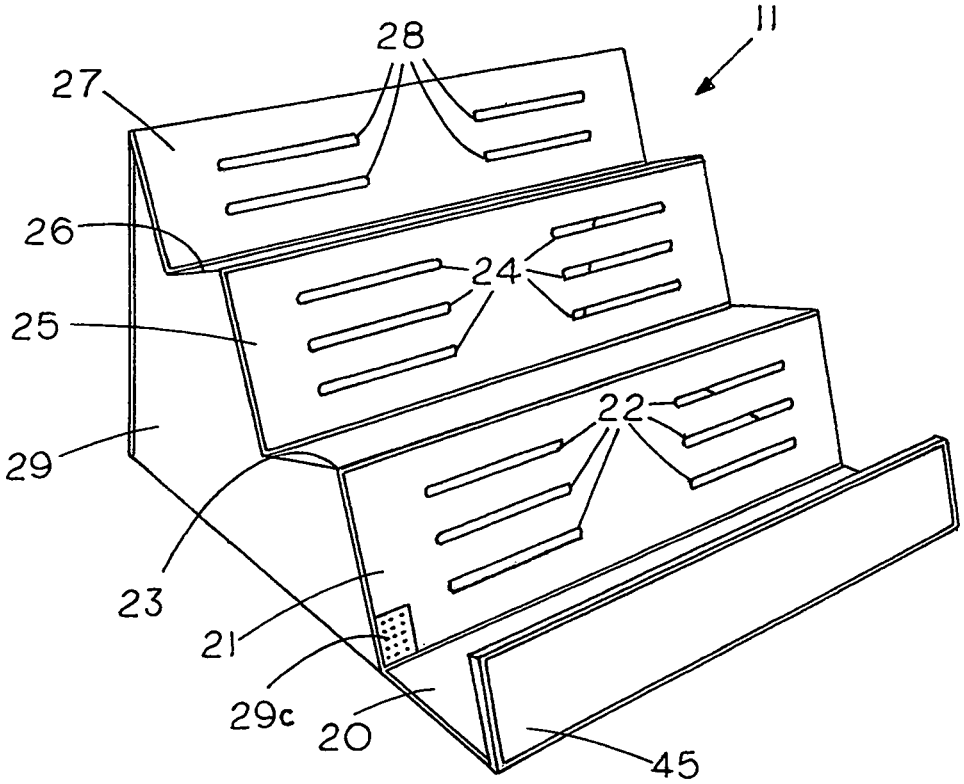
FIG. 4 is a perspective view of a product display stand with a front information panel with the product display stand including a processer that can be remotely controlled to select images and control the illumination for an electronic information panel on the product display stand.
Figure 4A:
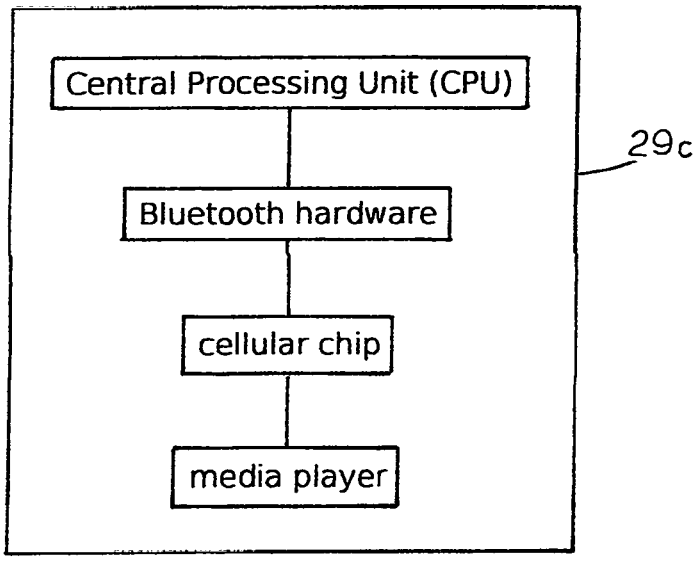
FIG. 4A is a box diagram showing a Central Processing, Unit (CPU), a Bluetooth hardware, a cellular chip, and a media player.

FIG. 4 is a perspective showing an embodiment of an identical display shelf riser or product display stand 11 as shown in FIG. 2 with the display shelf riser supportable and displayable in an enclosed refrigerated deli display case. As shown in FIG. 4 display stand 11 includes a riser body having at least two product supporting surfaces of different heights or steps for receiving and displaying refrigerated deli products such as meats and dairy products thereon in the enclosed refrigerated deli display case. However, unlike the display stand of FIG. 2, the display stand of FIG. 4 includes a Central Processing Unit (CPU), a Bluetooth hardware, a cellular chip, and a media player 29*c* all interconnected to each other and the LCD panel and all preferably located within the housing of product display stand 11. Thus, in the example of FIG. 4, if desired, an operator can control the content of the information panels on each of the product display stands from a remote location.

Figure 3:
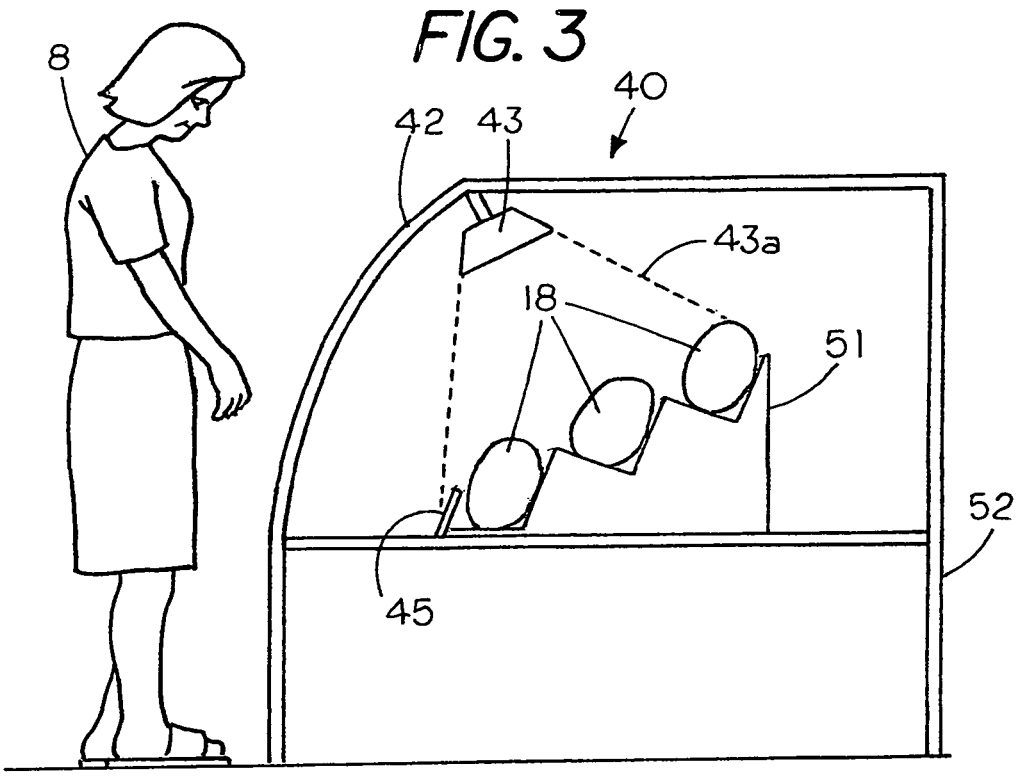
FIG. 3 is a side view of a customer in front of a refrigeration case where the meat products are illuminated by an incase light and the information panel on the product display stand contains a self illuminated panel viewable through a viewing window on the refrigeration case.

FIG. 3 shows an alternate embodiment of the invention where the product lighting is supplied by an incase light 43 that projects a light beam 43*a* directly onto the perishable products 18 within the case while the information panel 45 supplies its own illumination. In this example, refrigeration case 40 includes a housing 42 with a front viewing window 42 that allows a consumer 8 to view the products in the refrigeration case 40. In this example the refrigeration case 40 the incase light 43 projects a light beam 43*a* that directly illuminates the meat products 18 located on the product display stand 51 while the information panel 45 located in front of the products 18 supplies its own illumination so that the consumer can readily view the images on the information panel 45.

Figure 5:
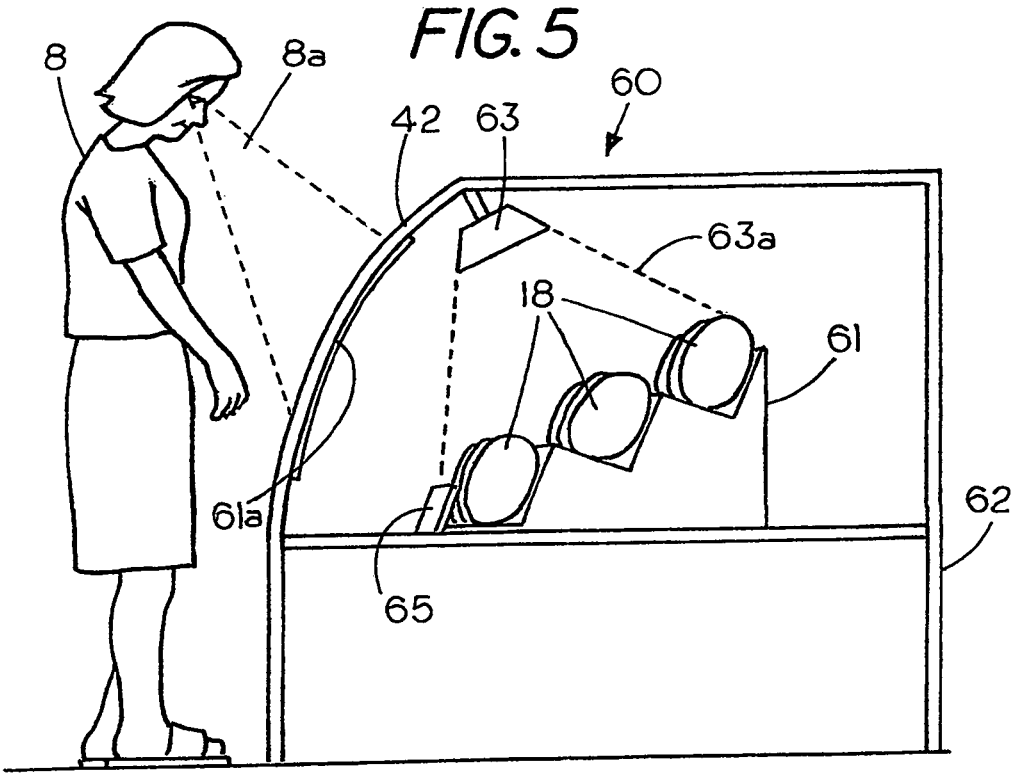
FIG. 5 is a side view of a display case with an information panel located on the viewing window of the display case and a projector within the display case.

FIG. 5 shows an alternate embodiment of the invention where the refrigeration case 60 includes a product display stand 61 with a perishable product such as meat products 18 located thereon, which is similar to FIG. 3. In this example, an information panel 61*a* is located on the window 42 of the refrigeration case 60. An incase light 63 directs light beam 63*a* onto the products 18 on the product display stand 61. Instead of an LCD information panel on the front of the product display stand 61 the stand includes a projector 65 that projects images onto a information panel 61*a*, which is located on the inside of display window 42, which allows the information to become visible to a person 8 standing outside the refrigeration case 60. For example, projector 65 may be a short throw projector or some other type of image projection system connected to the body of the product display stand 61 that can be used to project images on the information panel 61*a*, which comprises a viewing screen or film located on the inside surface of transparent window 42. In this example the projector 65 functions to project product information in the form of a video image onto information panel 61*a* comprising a transparent viewing film located on an interior surface of transparent display window 42 of the enclosed refrigerated deli display case 60 rather than proximate a product located on the product display stand 61. In this example the consumer 8 has a first field of vision 8*a* to view the informational panel and a second field of vision to view the products 18 within the refrigerator with both viewable from the same position outside the refrigerator case.

Although and LCD panel has been described other back lit panels as an LED panel may be used and the panel may comprise a variety of shapes and sizes, in the embodiment shown the LCD panel is shown as comprising a rectangular shaped body having a width of 24 inches or less and a height of 4 inches or less. In this example, which is shown in FIG. 4 the panel can interact with the Central Processing Unit (CPU), the Bluetooth hardware, the cellular chip, and the media player to display refrigerated deli products information and/or video images thereon. A feature of the invention is that the cellular chip connected to the Central Processing Unit is also in communication with the media player to enable the media player to update the content that is displayed on the information panel.

One of the advantages in the use of the LCD information panel is that the refrigerated deli product information video and images displayed thereon are less likely to be affected by illuminant lighting issues that may occur with some projection images. The presence of the LCD panel also enables the display shelf stand of FIG. 4 to be used in both an enclosed and an unenclosed refrigerated deli display case since the display shelf stand of FIG. 4 does not require an external surface for receiving the product information. Another feature of the displayer stand of FIG. 4 is that the body may include at least one speaker for delivering an audio product information message to the consumer in conjunction with the visual image, which may be useful with open front display cases.

I claim:

1. A display case comprising;

a housing having a product display compartment therein;

a refrigeration unit;

an incase light illuminating a product within the display case;

a display case shelf located within the display case ;

a window for a person peering into the product display compartment from outside the product display compartment ;

a product display stand located on the display case shelf with said product display stand having at least one display ledge and a self-illuminated information panel cantileverly extending an acute angle upward from the at least one display ledge, said self-illuminated information panel having internal light generation within the self-illuminated information panel displaying consumer information thereon with said product display stand supported by the display case shelf with the consumer information on the self-illuminated information panel changeable without opening the product display compartment, said self-illuminated information panel comprising a LCD panel viewable from outside the display case by the person in front of the window with the incase light projecting a light beam that directly illuminates a product on the product display stand while the self-illuminated information panel on the front of the product supplies its own illumination so the consumer can readily view an image on the information panel; and a Central Processing Unit (CPU), a Bluetooth hardware, a cellular chip, and a media player to enable an operator to remotely control the LCD panel from outside the display case.

* * * * *